US005441388A

United States Patent [19]

Berger

[11] Patent Number: 5,441,388

[45] Date of Patent: Aug. 15, 1995

[54] SHIP DRIVE WITH TWO COUNTERTURNING PROPELLERS

[75] Inventor: Günter Berger, Castrop, Germany

[73] Assignee: Mannesmann Aktiengesellschaft, Dusseldorf, Germany

[21] Appl. No.: 174,472

[22] Filed: Dec. 28, 1993

[30] Foreign Application Priority Data

Dec. 28, 1992 [DE] Germany ..... 42 44 586.8

[51] Int. Cl.[6] ..... B63H 5/10

[52] U.S. Cl. ..... 416/125; 416/129; 416/169 R; 416/170 R

[58] Field of Search ..... 416/125, 128, 129, 169 R, 416/170 R

[56] References Cited

U.S. PATENT DOCUMENTS

| | | | |
|---|---|---|---|
| 1,336,770 | 4/1920 | Wittmaack | 416/129 |
| 2,244,763 | 6/1941 | Bugatti | 416/129 |
| 3,527,545 | 9/1970 | Campbell et al. | 416/125 |
| 4,642,059 | 2/1987 | Nohara | 416/129 |

FOREIGN PATENT DOCUMENTS

| | | | |
|---|---|---|---|
| 132220 | 1/1985 | European Pat. Off. . | |
| 9000354 | 5/1990 | Germany . | |
| 3939187 | 9/1991 | Germany . | |
| 91848 | 3/1938 | Sweden | 416/125 |
| 115893 | 2/1946 | Sweden | 416/129 |
| 591492 | 8/1947 | United Kingdom | 416/125 |
| 1269043 | 3/1972 | United Kingdom . | |

*Primary Examiner*—Edward K. Look
*Assistant Examiner*—James A. Larson
*Attorney, Agent, or Firm*—Cohen, Pontani, Lieberman, Pavane

[57] ABSTRACT

A ship's drive with two counterturning propellers, the rear propeller of which is fastened to an inner shaft and the front propeller of which is fastened to the head end of a hollow shaft, which runs concentrically with the inner shaft. The hollow shaft is connected to a gearing and the inner shaft is connected to a propulsion unit. A gearwheel is disposed at the foot end of the hollow shaft which engages a further gearwheel which is fastened to an input shaft running parallel to the inner shaft. The input shaft can be connected with the output of a second engine.

5 Claims, 2 Drawing Sheets

SHIP DRIVE WITH TWO COUNTERTURNING PROPELLERS

BACKGROUND OF THE INVENTION

1. Field of the Invention

The invention relates to a ship drive with two counterturning propellers, the rear propeller of which is fastened to an inner shaft and the front propeller of which is fastened to the head end of a hollow shaft, which runs concentrically with the inner shaft, the shafts being connected to a gearing, and the input shaft of which being connected to a propulsion unit.

2. Description of the Prior Art

Propellers, rotating in opposite directions, have previously been used predominantly for smaller, conventional ship propulsion systems, for outboard motors and for sporting boats. In this respect, reference is made to the German patent 9,000,354. So-called CRP (contra rotating propeller) propulsion systems are also used for larger merchant vessels. For example, from the German publication 39 39 187 C2, a ship's propulsion is known, for which, with one main power plant, two propellers or screws are disposed on the same axle and a coaxial double axle of an inner and an outer shaft is gear reduced with respect to the rpm. As gearing, a planetary gear is used for the ship's propulsion known from this publication. On the one hand, the large number of individual elements is a disadvantage of this arrangement. In particular, the high number of planet wheels, which can reach the number 7 for the transmission of all input torque of 10,000 kNM, is disadvantageous here. Moreover, emergency operations are not possible in the event of difficulties with the propulsion unit or defects in components of the planetary gear. A failure of one of the elements of planetary gear usually leads inevitably to the destruction of the whole system, as a result of which the ship becomes disabled.

Furthermore, the requirement of a high propeller efficiency demands a precisely defined rpm ratio of the screws operating in opposite directions. Advantageous efficiency values are obtained when the inner propeller rotates 10% to 50% more rapidly than the outer one. By these means, however, transmission ratios arise for the usually used planetary gears which, due to the finite diameter of the planet wheel, can be realized technically in one step only at about 1:1.3. This problem then forces the designer to use stepped planets, which increase the number of gear parts even further in a disadvantageous manner.

SUMMARY OF THE INVENTION

Accordingly, it is an object of the present invention to provide a generic ship's propulsion, which drives merchant vessels with structurally simple means and a minimum of components for transferring power with little loss from the propelling unit to the screw, while conforming to the needs of maintenance and using fuel as sparingly as possible.

This object is achieved by passing the inner shaft through the gearing and fastening it at a foot end to an output shaft of a first engine. The foot end of the hollow shaft has a gear wheel that engages a further gear wheel fastened to an input shaft running parallel to the inner shaft. This input shaft being connectable with the output of a second engine.

Pursuant to the invention, a spur gear is used, which has only a few components. The inner shaft of the rear propeller is passed through the gearing and connected directly with the driving engine. The front ship's propeller, which is disposed on a hollow shaft, is connected with a single-step gear reduction with a second engine.

The two engines can be operated independently of one another and act in each case on one ship's propeller. This is true particularly in the case of emergency operations, so that, in the event of damage to one of the drive lines, the other can continue to be operated without interference.

In the case of a CRP operation, the rpm of the engines and the conversion ratio of the gearing can be adjusted in accordance with the design depending on the desired rotation ratio of the ship's propellers.

Because it is possible to design tire form of tire ship's propellers and the rotation ratio precisely and because of the slight loss during the transfer of power from the driving units to the screws, fuel savings of 10% are expected.

If only one CRP engine is to be used, a clutch is not needed between the driving unit and the gearing. Here it suffices to stop one engine.

The clear and easily surveyed construction of the ship's propulsion equipment furthermore permits standard thrust bearings to be installed easily for the propeller shafts. In an advantageous manner, the thrust bearing for tire hollow shaft can be installed between the propeller and the gearing. Moreover, the thrust bearing can be integrated into the housing of the gearing. Pursuant to the invention, the thrust bearing for the inner shaft is provided between the propulsion unit and the gearing. It is also possible for the thrust bearing to be integrated in the driving unit. In a different embodiment, the thrust bearing is disposed in the housing of the gearing.

For the gear reduction step, the gearing can have two output shafts so that it is possible to dispose the second engine on the side of the gearing facing the propeller as well on the side of the gearbox averted from the propeller.

Pursuant to the invention, the driving engine connected with the rear propeller is a slow-moving engine. Two-stroke engines are used here.

Furthermore, the front propeller is driven by an intermediate speed engine in the form of a four-stroke engine. Engines operating at an intermediate speed at about 400 to 800 revolutions per minute have gained acceptance in wide areas of merchant shipping because of their very favorable price-to-performance ratio while performing comparably. In the inventive combination with a slow-moving engine, which operates at about 55 to 200 revolutions per minute, a particularly inexpensive alternative, which moreover guarantees particularly high availability, arises out of the very simple construction of the gearing. Due to the redundancy of the driving engines and the possibility of alternatively operating only one engine, appreciable advantages arise for the ship builder.

If, for example, an engine operating at an intermediate speed of 450 rpm and a direct-driving slow-moving engine operating at about 100 rpm are used, a gear transmission of 5.6 to 6.7 results in the advantageous efficiency range of the counterturning propellers. This requires a particularly simple gear construction.

The various features of novelty which characterize the invention are pointed out with particularity in the claims annexed to and forming a part of the disclosure.

For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
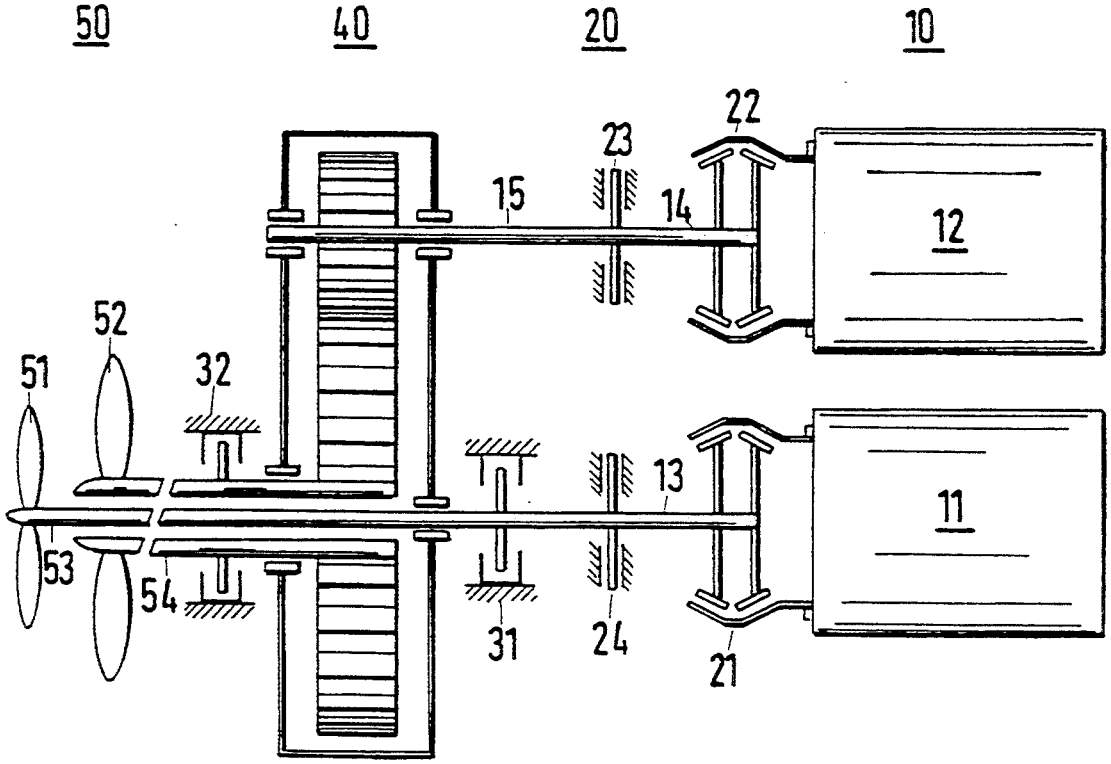
FIG. 1 shows the outline of a ship's propulsion plant with the engines disposed on one side of the gearing.
Figure 2:
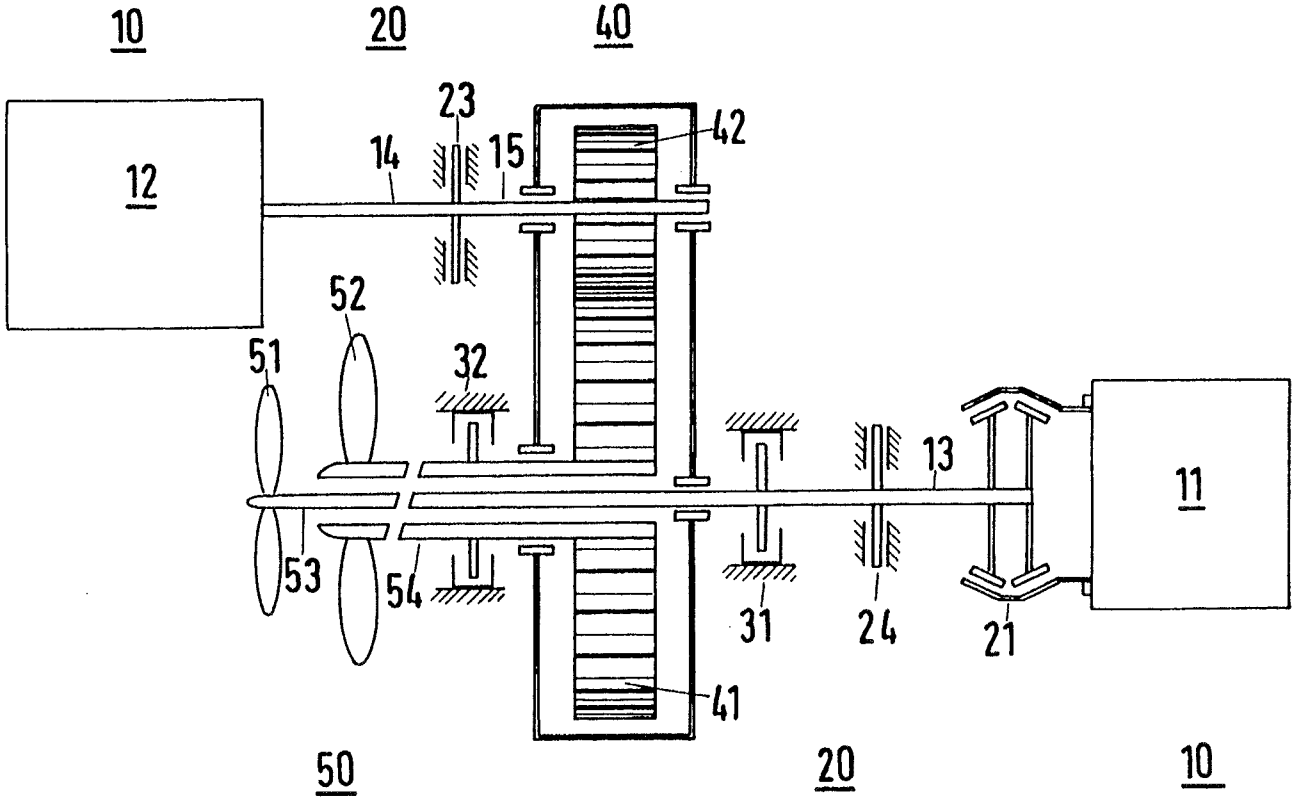
FIG. 2 shows the outline of a ship's propulsion plant with the engines disposed on both sides of the gearing.

FIGS. 1 and 2 show the outline of a ship's propulsion system with the engines 11 and 12 of the propulsion component 10: Engine 11 is connected over a clutch 21 with an output shaft 13, which is fastened to the inner shaft 53, which at the head end has the rear ship's propeller 51 of the power take-off component 50. The inner shaft 53 is passed through a hollow geared shaft of a gearing component 40. A thrust bearing 31 as well as a brake 24 are disposed between the gearing 40 and the clutch 21. In the construction of the ship's propulsion shown, the clutch 21 can be omitted.

A hollow shaft 54, which has a front ship's propeller 52 at one end and a gearwheel 41 at the other end, runs concentrically with the inner shaft 53.

A thrust bearing 32 is disposed between the ship's propeller 52 and the gearing 40.

The gearwheel 41 is engaged by a gearwheel 42, which is smaller in diameter and is connected over an input shaft 15 with the output shaft 14, which is connected with the engine 12. The shaft 14, 15 has a brake 23. The output shaft 14 is connected by way of a clutch 22 (only in FIG. 1) with the engine 12.

In the drawing, the engine 11 is constructed as a slow-moving engine and the engine 12 as an engine operating at all intermediate speed.

FIG. 2, in which the same reference symbols are used, shows a possible variation of the installation described. The intermediate speed engine, which is a smaller construction, is disposed next to the propeller shafts, which leads to an overall, very compact, propulsion system. As is customary with such installations, the generator producing the ship's current is connected to the input side of the gearing. This could operate alternatively as a power take-off (PTO) or as a power take-in (PTI). Moreover, the clutch 22 was omitted.

Taking into consideration the different rpm of the engines and the required difference in rpm between the front propeller and the rear propeller of 10–50%, the ratio of the number of teeth of the gearwheel 41 fastened to the hollow shaft 54 to the number of teeth of the gearwheel 42 disposed on the input shaft 15 is 2 to 7.5.

I claim:

1. A ship drive, comprising: an inner shaft having a foot end and a head end; a hollow shaft having a foot end and a head end concentric to the inner shaft; two counterturning propellers including a rear propeller fastened to the head end of the inner shaft and a front propeller fastened to the head end of the hollow shaft; a gearing connected to the hollow shaft and having an input shaft parallel to the inner shaft, the gearing including a first gearwheel disposed on the input shaft and a second gearwheel disposed at the foot end of the hollow shaft and engaging the first gear wheel; a first engine having an output shaft, the inner shaft being arranged to pass through the gearing and being fastened at its foot end with the output shaft of the first engine; a second engine having an output shaft, the input shaft of the gearing being connectable to the output shaft of the second engine; a first thrust bearing disposed on the hollow shaft between tire front propeller and the gearing; a second thrust beating arranged on tire inner shaft so as to be disposed between the gearing and the first engine, the ratio of the number of teeth of the second gearwheel disposed on the hollow shaft to the number of teeth of the first gearwheel disposed on the input shaft is 2 to 7.5; a clutch provided at the output shaft of the first engine; braking means connected to the output shaft of the first engine, the clutch and braking means being adapted to stop the inner shaft and the output shaft of the first engine; and additional braking means arranged on the output shaft of the second engine for stopping the input shaft of tire gearing.

2. A ship drive as defined in claim 1, wherein the first engine is a slow-moving two-stroke engine and the second engine is an intermediate speed four-stroke engine.

3. A ship drive as defined in claim 1, wherein the ratio of the number of teeth of the second gear wheel to the number of teeth of the first gearwheel is based upon differing revolutions per minute of the engines and a required difference in revolutions per minute between the front propeller and the rear propeller of 10 to 50 percent.

4. A ship drive as defined in claim 1, wherein the second engine is a medium speed four-stroke engine.

5. A ship drive as defined in claim 4, and further comprising clutch means for connecting the output shaft of the second engine with the gearing, the clutch means being engageable and disengageable.

* * * * *